US005146774A

United States Patent [19]

Smith

[11] Patent Number: 5,146,774

[45] Date of Patent: Sep. 15, 1992

[54] LIFT MECHANISM FOR INSTALLATION AND REMOVAL OF PRESS BRAKE DIES

[75] Inventor: Dana C. Smith, Benton, Kans.

[73] Assignee: Uniflo Conveyor, Inc., Wichita, Kans.

[21] Appl. No.: 661,883

[22] Filed: Feb. 27, 1991

[51] Int. Cl.[5] ..... B21J 13/00

[52] U.S. Cl. ..... 72/446; 72/389; 72/448; 72/481; 100/918

[58] Field of Search ..... 72/389, 446, 448, 481; 100/224, 918

[56] References Cited

U.S. PATENT DOCUMENTS

| | | | |
|---|---|---|---|
| 4,301,673 | 11/1981 | Yonezawa | 72/448 |
| 4,317,358 | 3/1982 | Yonezawa et al. | 72/448 |
| 4,506,538 | 3/1985 | Jones, Jr. | 72/389 |
| 4,691,554 | 9/1987 | Murphy | 72/481 |

FOREIGN PATENT DOCUMENTS

| | | | |
|---|---|---|---|
| 48431 | 4/1980 | Japan | 72/481 |

*Primary Examiner*—David Jones

*Attorney, Agent, or Firm*—Donald W. Margolis; Edwin H. Crabtree

[57] ABSTRACT

This device assists with the disengagement from and installation of a press brake die on a press brake. It includes a die receiving and holding device having a surface along which are located a number of spaced apart openings, each opening terminating at the surface of the press brake, adjacent to any press brake die which is in the press brake. Devices for engaging the bottom of a die are located within each opening, normally below the surface, but capable of movement out of the opening and above the surface. When the devices for engaging the die are moved out of their openings they engage the bottom of any die which is present, and move it away from the surace of the press brake. The system includes a mechanism for activating the movement of each die engaging device above the surface, and also for moving each die engaging device back below the surface of the press brake. In preferred embodiments, the die receiving and holding device is a filler block having a groove for receipt of a tang on a female die, the devices for engaging the die are rollers, and the mechanism for activating the movement of each die engaging device includes a crankshaft having an accentric and connected to a roller, which crankshaft is capable of rotation in two directions by connection to a lever arm, which is in turn connected by rods which make up a linkage to the piston of a pneumatic cylinder and piston combination.

22 Claims, 3 Drawing Sheets

LIFT MECHANISM FOR INSTALLATION AND REMOVAL OF PRESS BRAKE DIES

BACKGROUND OF THE INVENTION (a) Field of the Invention

This invention relates to a device for lifting dies and more particularly, but not by way of limitation to a lift mechanism used in a filler block of a press brake for removing and installing press brake dies.

(b) Description of the Prior Art

Heretofore, there have been a variety of adjustable die holders and compensating brake die holders having a plurality of adjustable wedges for providing vertical adjustment and compensating camber to die holders. These type of adjustable wedges are described, for example in Bath U.S. Pat. No. 2,456,856; Fritsch; U.S. Pat. No. 3,587,286; Roch U.S. Pat. No. 3,965,721; Deguchi U.S. Pat. No. 4,354,374; and Russell U.S. Pat. No. 4,736,612. None of these above-mentioned patents disclose a lift mechanism for easily removing and installing press brake dies.

In Murphy U.S. Pat. Nos. 4,691,554 and 4,700,624; Fleischer, et al. U.S. Pat. No. 4,819,554; and Fisch U.S. Pat. No. 4,669,297, a number of different types of die transfer systems are described for use with punch presses and injection molding fixtures having a bolster plate with a conventional inverted T-slot. The T-slots are used both to contain a lift device and to pull a tooling fixture surface against the bolster plate. The lift device is compressed by variously using bellville springs, elastomeric coils and air bags. None of these patents describe the unique combination and structure described herein as used with a filler block in a conventional press brake operation.

SUMMARY OF THE INVENTION

An object of the present invention is to provide a mechanism for the change out operation of a press brake die which can be handled by a single operator.

Another object of the present invention is to provide a lift mechanism for press brake dies which will allow a single operator of a press brake to easily disengage and remove a press brake die, and to install new dies, all without the need to use a pry-bar and mallet.

A still further object of the present invention is to provide a lift mechanism for use in changing die sets in a press brake operation, thereby allowing quicker and less hazardous die changes, as compared with current operations, greatly reducing machine tool set up time, and thereby also minimizing the inventory of formed metal parts which must be kept in stock.

Another object of the present invention is to reduce sliding friction of dies during their installation and removal, through the use of rollers on the filler block.

Still another object of the present invention is to provide a lift mechanism for use in the changing of long and/or heavy dies, i.e. up to 40 feet in length and from several pounds per foot to as much as 50 pounds per foot, or more.

Also, another object of the present invention is to provide a die lift mechanism which can be installed as a part of a new press brake installation, or applied as a retro-fit application to existing press brake equipment.

The present invention relates to a mechanism which assists with the disengagement and installation of a press brake die from a press brake. The mechanism consists of a press brake die receiving and holding device having a longitudinal surface. A number of spaced apart openings are located along its surface, each opening terminating at the surface of the press brake where it will be adjacent to any press brake die which is held by the press brake.

Devices for engaging the bottom of a press brake die are located within each opening. Each device for engaging a press brake die bottom is normally within its opening, below the longitudinal surface of the press brake die receiving and holding device, but is capable of movement out of its opening and above the longitudinal surface of the press brake die receiving and holding device. When devices for engaging the press brake die bottom are moved out of their respective openings they engage the bottom of any press brake die which is held by the press brake die receiving and holding device and move them away from and out of contact with the press brake die receiving and holding device, for ease of removal from the press brake. The system includes a mechanism for activating the movement of each press brake die bottom engaging device above the surface, and also for moving each press brake die bottom engaging device back below the surface of the press brake die receiving and holding device.

In preferred embodiments, the mechanism for disengaging a press brake die from a press brake, includes a filler block mounted on the press brake. The filler block carries the press brake die receiving and holding device having a longitudinal surface, and a number of spaced apart cavities disposed along its longitudinal surface, either linearly in a single line, linearly in a pair of parallel lines, or in other patterns along the surface. The number and distribution of the cavities, and therefore of the bottom engaging devices, will depend upon the size and weight of the press brake die which is to be handled by the system. The device which engages the bottom of any press brake die is preferably a number of rollers which are disposed in each cavity. Each roller is capable of movement out of the cavity above the longitudinal surface of the filler block. A number of bushings are disposed in the filler block, and a crankshaft is rotatably mounted within each bushing within the filler block. Each crankshaft has a first end and a second end, and includes an eccentric portion at its first end. The eccentric portion of each crankshaft is connected to the center of one of the rollers. In preferred embodiments the rollers are connected to the crankshafts by bearings. A number of thrust plates are also connected to the filler block. Each thrust plate engages a portion of the second end of each crankshaft, thereby preventing axial movement of that crankshaft.

One or more piston and pneumatic cylinder combinations are provided. Each pneumatic cylinder is capable of imparting controlled motion to its associated piston in a first direction and in a second direction. The piston is connected to each crankshaft by at least one lever arm which is in turn connected to the second end of that crankshaft. In some instances the lever arm is connected by a linking device to the piston. Each linking device includes one or more rod which is connected between a lever arm and its associated piston, to thereby effectively link each second end of each crankshaft to that piston. In preferred embodiments of the present invention, the linking device may include a number of rods connected in series with one another, with one end of the series of rods connected to a piston, and with one end of the series of rods connected to one of the lever arms which is in turn connected to the crankshaft.

When the pneumatic cylinder is actuated in an extended position, the piston is moved in a first direction, the linkage moves the lever arms forward which rotates the crankshaft in a manner which causes the eccentric portion of the crankshaft to be rotated in a manner which moves the connected roller above the surface of the press brake die receiving and holding device. This causes the roller to first engage the bottom of any press brake die which is held by the press brake die receiving and holding device, and then moves the roller out of the cavity, so that any die which is present is moved away from and out of contact with the surface of the press brake die receiving and holding device. The press brake die can now be easily rolled along the rollers the length of the filler block and removed from the press brake.

When a press brake die is placed in the press brake die receiving and holding device, the cylinder retracts the piston to a second position. This causes the linkage to move the lever arm backward, which in turn rotates the crankshaft in the opposite direction, and lowers the retractable rollers into the cavities below the surface of the press brake die receiving and holding device to allow any press brake die which is present to move into contact with the surface of the press brake die receiving and holding device.

The mechanism is activated by a control panel mounted on a hinged bracket which is attached to the press brake. An electric switch mounted on the control panel is operatively connected to the pneumatic cylinder for actuating the piston in either its first extended direction, to cause any such die which is present to move away from and out of contact with the surface of the press brake die receiving and holding device. the switch can also be used for actuating the piston in its second retracted direction to cause the roller to be moved below the surface of the press brake die receiving and holding device to allow any press brake die which is present to move into contact with the surface of the press brake die receiving and holding device.

Normally, the mechanism of the present invention is intended for use in the lower half of a press brake with a female press brake die having a die tang on its bottom along the length thereof. In such preferred embodiments, the press brake die receiving and holding device carries a filler block groove along the longitudinal surface thereof for receiving such a die tang.

As used herein a "die pair" or "die set" is a combined male and female die of such size and shape that the male fits within the female in a snug mating relation for carrying out metal bending operations between the dies.

This present invention is especially useful when utilized in conjunction with the invention of patent application Ser. No. 628,990, filed Dec. 13, 1990, for AUTOMATED DIE TRANSPORT SYSTEM, and assigned to the assignee of the present application. The combined inventions help to reduce costs of manufacturing, by allowing the production of parts, as demand dictates, which is referred to as "just in time" manufacturing, which reduces overall job part costs. Such systems are contrasted to batch manufacturing of large quantities inventory, which ties up money in both inventory and warehousing.

These and other objects of the present invention will become apparent to those skilled in the art from the following detailed description, showing the contemplated novel construction, combination, and elements as herein described, and more particularly defined in the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
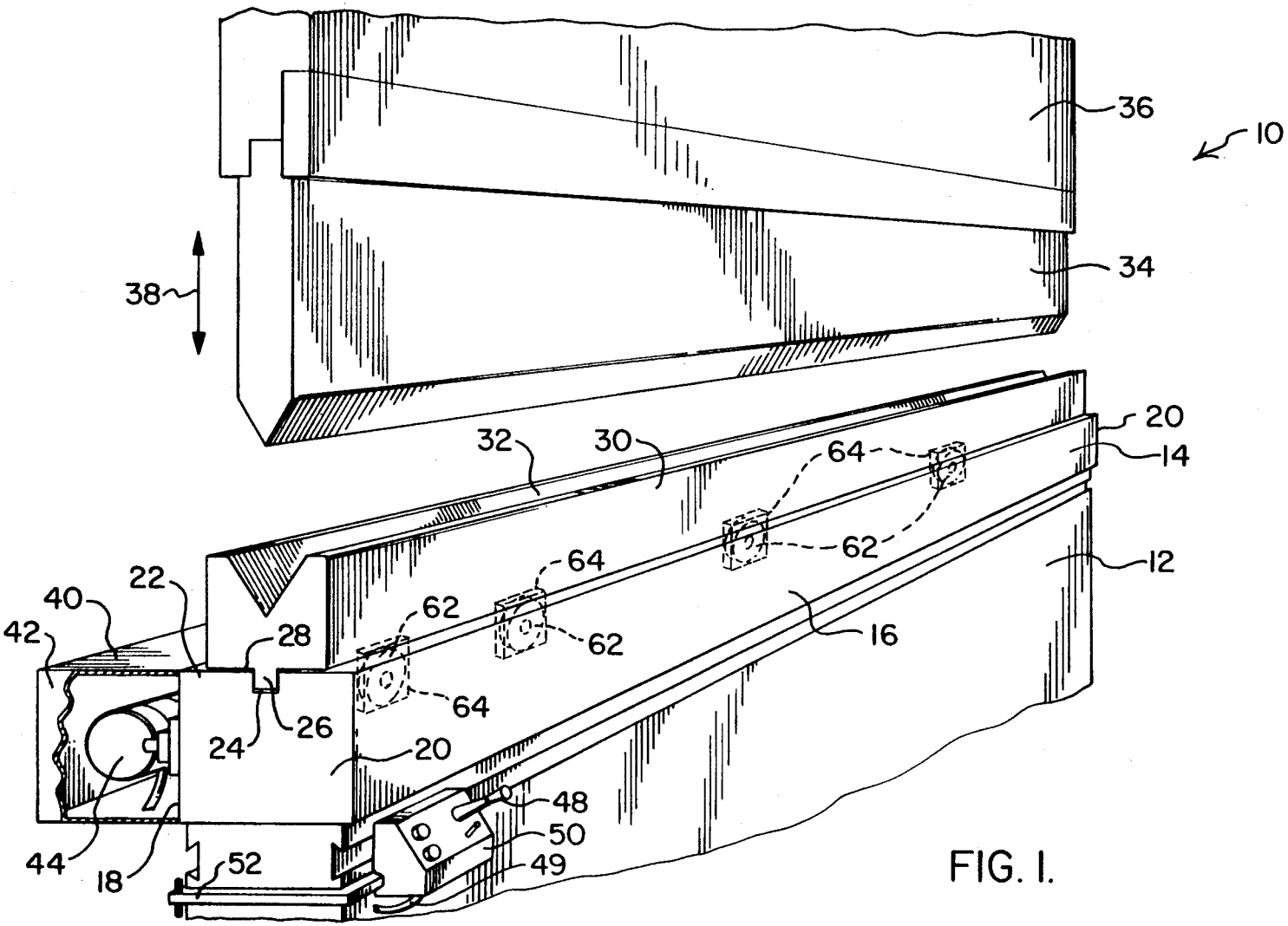
FIG. 1 is a broken away perspective view, partially cut away, and partially in phantom, of a press brake with a set of male and female dies, and including the mechanism of the present invention for disengaging and installing a press brake die from a press brake, including a plurality of rollers, shown in phantom, in cavities below and along a length of a filler block groove in a filler block.

In FIG. 1, a broken away portion of a standard press brake having general reference numeral 10, is shown. Press brake 10 includes a base 12 having a filler block 14 on top thereof. Filler block 14 has a front side 16, a back side 18 (FIG. 2), ends 20, and a top 22. Disposed in top 22 and along the length of filler block 14 is an angular filler block groove 24. Filler block groove 24 receives a die tang 26 which runs the length of bottom 28 of female die 30. Male die 34 is disposed above and parallel to female die 30. Male die 34 is connected to a press ram 36 which lowers and raises male die 34 as indicated by arrow 38. Male die 34 is attached to press ram 36 and female die 30 is attached to filler block 14, for example, using horizontal set screws, not shown. Top 32 of female die 30 has various angular configurations for mating with similar mirror image angular configurations of male die 34, which die set forms angular bends in metal parts.

While a single die set is shown, it should be kept in mind that because dies can be of different sizes, lengths, and weight, the female die 30 and male die 34 may come in divided segments. For example, lightweight dies may come in a single length of 10 feet, while heavier dies may be divided into 5 foot lengths. Further, the length of the press brake may be as much as 40 feet, or greater, with the die sets then coming in 5 feet segments requiring, for example, four male segments and four female segments to complete the die set. The subject lift mechanism, as will be described herein, is easily adaptable for lifting various lengths and different weights of dies.

Figure 3:
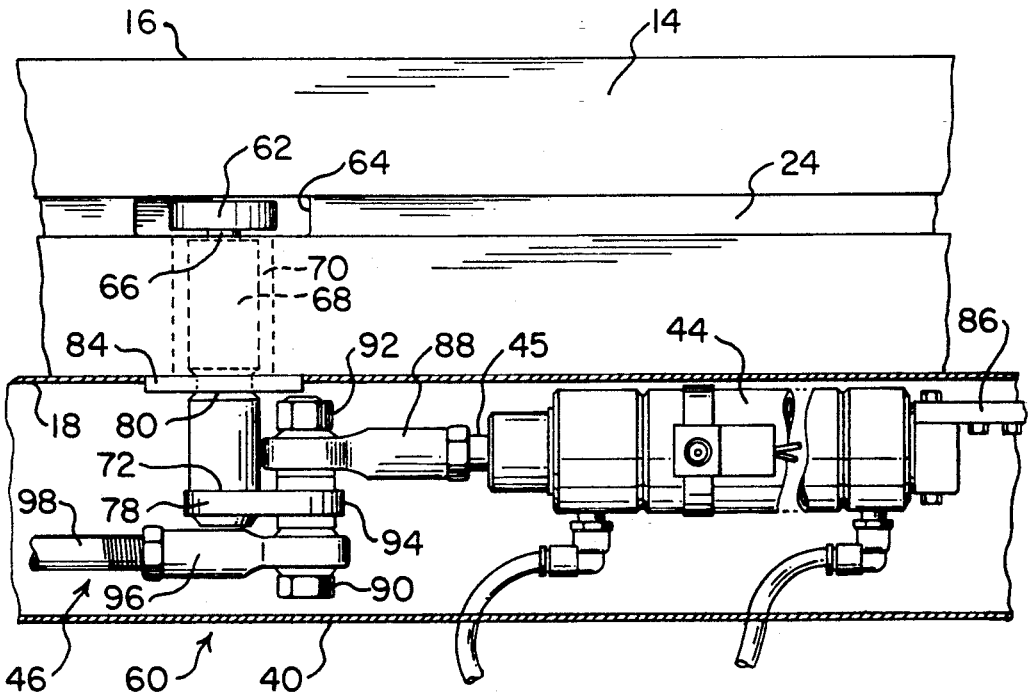
FIG. 3 is a broken away top plan view of a portion of the filler block and a portion of a pneumatic cylinder and piston connected by a connecting rod linkage to a crankshaft.

Mounted on the back 18 of filler block 14, and along its length is a cover 40. An end 42 of cover 40 is cut away in FIG. 1 in order to expose one end of a pneumatic cylinder 44. Pneumatic cylinder 44, including piston 45, is shown in FIG. 3, connected to a connecting rod linkage assembly, generally 46. Piston 45 in cylinder 44 and connecting rod linkage 46 is actuated by operating an electric switch 48 on a control panel 50. Switch 48 is connected to an electrical lead 49 which goes to an electrical system for actuating the operation of cylinder 44. The electrical control system is state of the art, and its details are not shown. Panel 50 is mounted on a hinged bracket 52, which allows it to be moved out of the way when the lift mechanism is not required.

Figure 2:
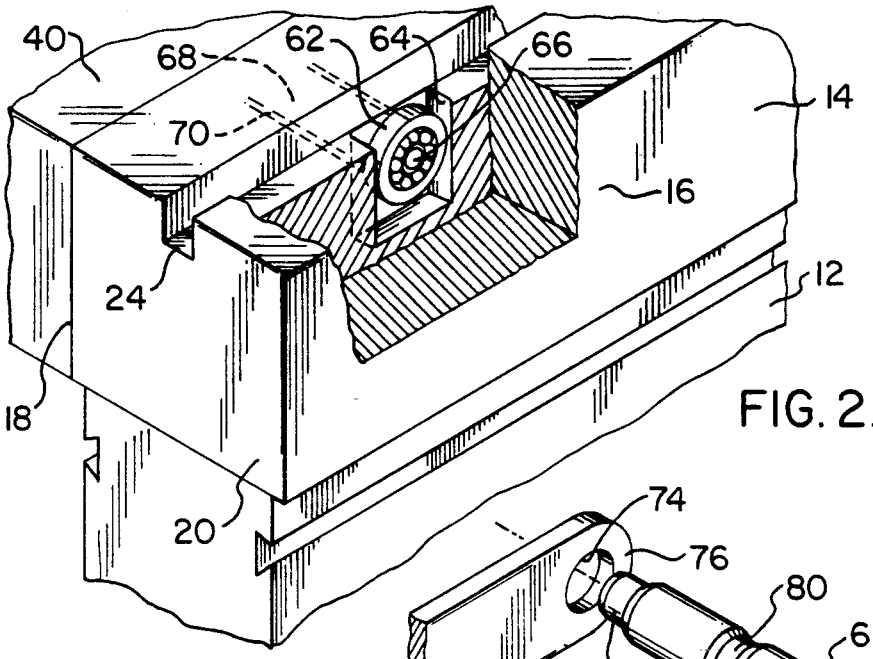
FIG. 2 is a broken away perspective view, partially in phantom, of a portion of the press brake filler block with a section of the filler block cut away to show the details of one of the rollers in its cavity.

Referring now to FIGS. 4–7, the subject lift mechanism for removing and installing press brake dies is designated by general reference numeral 60. Lift mechanism 60 includes a plurality of retractable rollers 62 which are shown to include bearings 63 (FIG. 2A), or the like. Each roller 62 is located in a cavity 64, which cavities 64 are shown to be machined out of the bottom of filler block groove 24 and into filler block 14 as shown in FIG. 2. Cavities 64 are of sufficient size to collect any debris that may fall into groove 24 and then into cavity 64 without interfering with the retraction and extension operation of roller 62.

Referring again to FIG. 1, a plurality of rollers 62 and cavities 64 are shown in phantom disposed under die tang 26 with rollers 62 engaging the bottom of tang 26 and raising female die 30 slightly above filler block 14 so that it may be removed, for example onto a die transfer cart, not shown, and replaced with another female die. The spacing of cavities 64 and the number of rollers 62 will vary depending on the size, weight, and number of dies used, although a minimum of thee rollers is preferred. Also, if the dies are always changed from the left side of press brake 10, then rollers 62 may be spaced more closely together along the left side of filler block 16 since the majority of the die weight will be placed primarily in this area during die change outs.

In FIG. 2 a perspective view of a portion of filler block 14 is shown with a section cut out to expose one of cavities 64 therein. In this view, and in FIG. 4, one of the retractable rollers 62 is illustrated in a retracted or "Down" position with the outer circumference of roller 62 below the surface of the bottom of filler block groove 24.

Figure 2A:
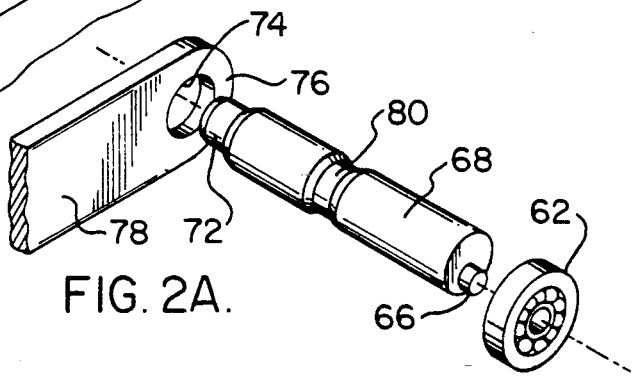
FIG. 2A is a broken away exploded perspective view of a crankshaft and lever arm, with an eccentric shaft at one end for receiving a roller.

The center of roller 62 is mounted on an eccentric shaft 66 which extends outwardly from a crankshaft 68 which is rotatably mounted on a bronze bushing 70 (FIGS. 2, 3, 4 and 6) disposed in the backside 18 of filler block 14 and perpendicular thereto. In FIG. 2A an exploded perspective view is shown of crankshaft 68, in its entirety, with the center of roller 62 positioned for receipt on eccentric shaft 66. End 72 of crankshaft 68 has a reduced diameter for receipt in an opening 74 on an end 76 of a lever arm 78. Also, midway along the length of crankshaft 68, where crankshaft 68 extends outwardly from the backside 18 of filler block 14, a shoulder groove 80 is defined therein for receiving an interface slot 82 (FIG. 7) of thrust plate 84. Interface slot 82 has a diameter greater than the diameter of shoulder 80, but less than the diameter of crankshaft 68. Thrust plate 84, prevents axial movement of crankshaft 68 along the length of bushing 70.

Pneumatic cylinder 44 is movably mounted on bracket 86 attached to filler block 14. Piston 45 is connected to a first rod clevis 88 with right hand threads which is attached to a linkage bolt 90 with nut 92. Bolt 90 is attached to an opposite end 94 of lever arm 78. Also, a second rod clevis 96 with left hand threads is attached at one end to bolt 90 and at another end to a linkage rod 98. The connecting rod linkage 46 may be made up of a plurality of linkage rods 98, bolts 90, and lever arms 78 which extend, and which are connected to each crankshaft 68. The threads of connecting rod linkage 46 in second rod clevis 96 provide a turn buckle effect, in that they allow the length of the linkage to be adjusted, thereby making the height of the rollers 62 adjustable. While only one pneumatic cylinder 44 is shown, more than one cylinder 44 may be required to lift a plurality of rollers 62 when handling long and heavy press dies.

Figure 5:
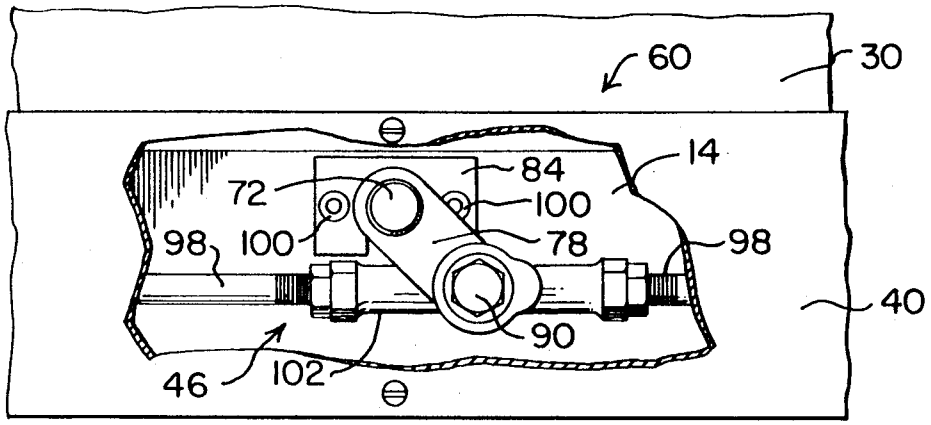
FIG. 5 is a side elevational view of a portion of the connecting rod linkage showing a lever arm and connecting rod segments as they are positioned in FIG. 4, when the roller is out of engagement with the die.
Figure 4:
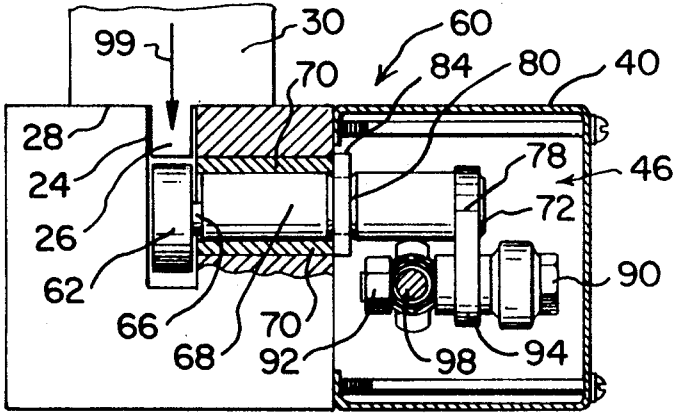
FIGS. 4 is a cut away elevational end view of the filler block showing a roller in a cavity and out of engagement with the die.

Referring to FIGS. 4 through 7, the separate roller 62 lifting and the roller 62 retracting operations are further illustrated. In FIGS. 4 and 5, female die 30 is shown resting on top of filler block 14, as indicated by arrow 99, with die tang 26 received and held in filler block groove 24. The retractable roller 62, shown in FIG. 4, is in a "down" position with the outer diameter of roller 62 below the surface of filler block groove 24, and also below and out of contact with the bottom surface of die tang 26. In this configuration, any press brake force placed on female die 30 is not transmitted to roller 62 during normal operation of press brake 10.

In the position shown in FIGS. 4 and 5, eccentric shaft 66 on crankshaft 68 is in a lowered, or 6:00 o'clock position, similar to the position shown in FIG. 2A. In the side view shown in FIG. 5, connecting rod linkage 46 is shown in a retracted position, with piston 45 received in a retracted position in cylinder 44, similar to that shown in FIG. 3. Lever arm 78 is in a 4:00 o'clock position. A third clevis 102, with left hands threads, is used for connecting an additional linkage rods 98 in series between piston 45 and the lever arm of another crankshaft connection. Also shown in FIG. 5 are counter sunk machine screws 100 used to secure thrust plate 84 to filler block 14.

In operation, when it is desired to change out male die 34 and female die 30, ram 36 is lowered, as shown by arrow 38 in FIG. 1. Then, male die 34 is released from ram 36 and slid, for example, to the left, onto an adjacent die transport cart, not shown, which is positioned near the left end of press brake 10. After male die 34 has been removed, switch 48, shown in FIG. 1, is moved upward to activate pneumatic cylinder 44. If female die 30 is held in place by set screws, not shown, and is not merely floating free on top of filler block 14, then the set screws would first be loosened before moving switch 48, to lift rollers 62.

Figure 7:
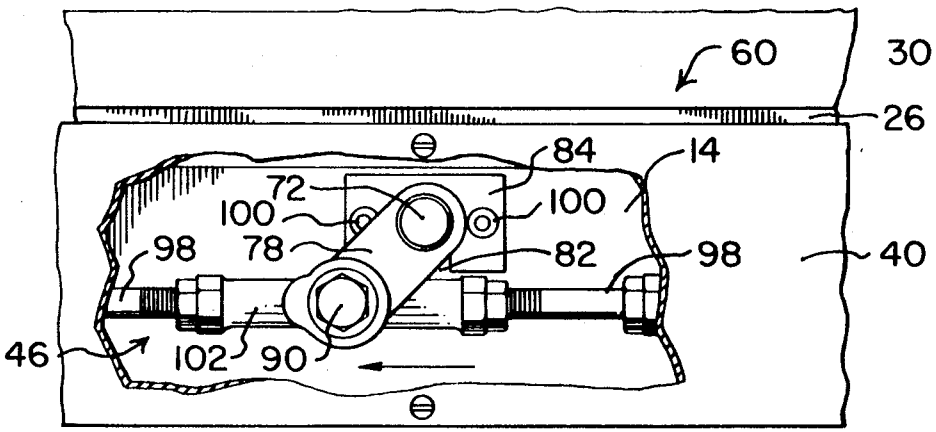
FIG. 7 is a side elevational view of a portion of the connecting rod linkage showing a lever arm and connecting rod segments as they are positioned in FIG. 6, showing the lever arm and connecting rod segments in an extended position so that the roller is in engagement with and lifting a die above the top of the filler block.
Figure 6:
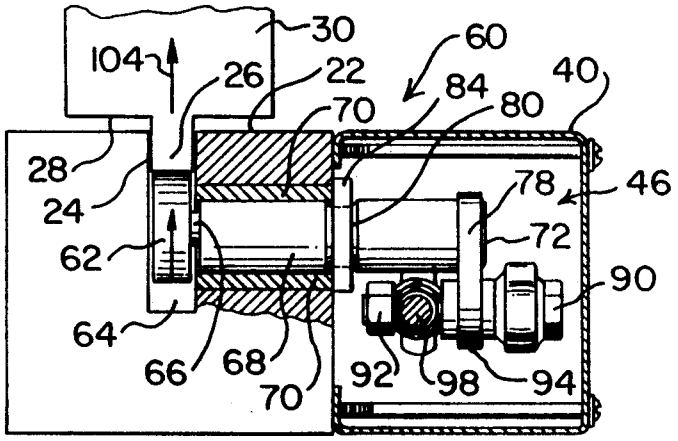
FIG. 6 is a cut away elevational end view of the filler block showing the roller above the surface of its cavity and in engagement with and lifting a die above the top of the filler block.

Referring to FIGS. 6 and 7, the operation of the roller 62 lifting mechanism is shown. In FIGS. 6 and 7 after cylinder 44 has been activated by moving switch 48 upward, piston 45 is moved to an extended position, as shown in FIG. 7. When this occurs linkage 46 moves to the left. Lever arms 78 move from their 4:00 o'clock position, as shown in FIG. 5, to an 8:00 o'clock position as shown in FIG. 7. As this movement occurs linkage rods 98 and rod clevises 88, 96 and 102 lower as they move from right to left. Since cylinder 44 is movably mounted on bracket 86, it is also able to rotate as linkage 46 rotates. At the same time, time, lever arm 78 rotates crankshaft 68 moves approximately 90 degrees. As crankshaft 68 is turned, eccentric shaft 66 moves from the 6:00 o'clock position, as shown in FIGS. 2A and 4, towards a 9:00 o'clock position, as shown in FIG. 6. This movement of eccentric shaft 66 causes retractable roller 62 to be moved upward through cavity 64 until it engages the bottom of die tang 26. As piston 45 reaches its fully extended position, and eccentric shaft 66 moves upward to its 9:00 o'clock position, roller 62 is also moved upward above the top surface of groove 24 of filler block 14, as indicated by arrow 104. The movement of roller 62 above the top surface of groove 24 of filler block 14 also moves die tang 26 upward and out of contact with groove 24, and die 30 out of contact with filler block surface 22. When female die 30 is moved above top surface 22 of filler block 14, female die 30 can then be easily and quickly slid over rollers 62, for example to the left, and placed on a die transfer cart, not shown. The amount of vertical movement of rollers 62 will vary, depending on the application and amount of movement desired, although movement of rollers 62 by as little as ⅛ inch above the surface of cavity 64 is sufficient to disengage the die from filler block 30.

While rollers 62 are in this extended position, a new female die, not shown, may now be chosen and slid to the right on top of extended rollers 62, and properly positioned along the length of filler block 14. When new female die is in place, switch 48 is moved downward on panel 50. This causes reverse activation, or retraction, of cylinder 44, which in turn causes piston 45 to return to its retracted position as shown in FIGS. 3 and 5. This then causes linkage 46 to move from left to right and returns to its position as shown in FIGS. 4 and 5. This in turn causes crankshaft 68 and eccentric shaft 66 to rotate from its 9:00 o'clock position back to its 6:00 o'clock position. This movement, in turn, causes rollers 62 to be lowered, thereby lowering the bottom of die tang 26 so that the new female die 30 come to rest on top 22 of filler block 14 as shown in FIG. 4. A new male die 34 can now be slid on top of female die 30 and cradled thereon, and ram 36 lowered to receive the new male die at the same time. The male die is then secured to ram 36 using, for example, set screws. Press brake 10 is now ready to perform a different metal bending operation with a new die set.

It will be readily understood that the present invention can be installed as a part of a new press brake installation, or applied as a retro-fit application to existing press brake equipment. Since most of the mechanism of the present invention is mounted on the back 18 of filler block 14, and along its length, with the exception of the cavities 64 for rollers 62, and the openings for crankshafts 68 in filler block 14, it can be easily retro-fit. Thus, for example, if cavities 64 and the openings for crankshafts 68 are machined into filler block 14, the balance of the mechanism of the present invention can be easily located on the back of the filler block 14, as a retro-fit.

It is thus seen that the present invention provides a lift mechanism for press brake dies which allows an operator of a press brake to easily remove, and to install new dies, all without the use of a pry-bar and mallet. The mechanism allows the change out operation of a press brake die which can be handled by a single operator. The lift mechanism allows the changing of die sets in a press brake operation, in a manner which is quicker and less hazardous, as compared with current operations. It greatly reduces machine tool set up time, and thereby also minimizes the inventory of formed metal parts which must be kept in stock. The present invention also provides, through the use of a lift mechanism and mechanically actuated rollers, a reduction of sliding friction of dies during their installation and removal. This allows the changing of long and/or heavy dies, i.e. up to 40 feet in length and from several pounds per foot to as much as 50 pounds per foot, or more. It has been shown that the die lift mechanism of the present invention can be installed as a part of a new press brake installation, or applied as a retro-fit application to existing press brake equipment with little down time. As noted above, the die lift mechanisms may be arranged linearly, or in one or more parallel row, or in other patterns.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiment of the invention for which an exclusive privilege and property right is claimed are defined as follows:

1. A mechanism for disengaging and installing a press brake die having a lower tang on the lower surface of a press brake, the mechanism comprising:

press brake die tang receiving and holding means in the form of a groove having a lower longitudinal surface;

a plurality of spaced apart openings defined along the length of said lower longitudinal surface of said groove of said press brake die receiving and holding means, each said opening terminating at said lower surface of said groove of said press brake die receiving and holding means, said termination of each said opening being substantially adjacent to any press brake die tang which may be received and held by said groove of said press brake die receiving and holding means;

a plurality of means for engaging the bottom of a tang of a press brake die, each said press brake die tang bottom engaging means being located within one said opening, each said press brake die tang bottom engaging means normally being within its said opening below said lower surface of said groove of said press brake die receiving and holding means, but capable of movement out of its opening and above said lower surface of said groove of said press brake die receiving and holding means to thereby engage the bottom of any press brake die tang which is received and held by said press brake die receiving and holding means, whereby any such die will be moved away from and out of contact with said groove of said press brake die receiving and holding means; and means for moving said plurality of press brake die bottom engaging means above said lower surface of said groove of said press brake die receiving and holding means to thereby engage the bottom of any press brake die tang which is held by said groove of said press brake die receiving and holding means, and move any such die tang away from and out of contact with said lower surface of said groove of said press brake die receiving and holding means.

2. The mechanism as described in claim 1 wherein there are also means for moving each said press brake die bottom engaging means below said surface of said press brake die receiving and holding means.

3. The mechanism as described in claim 1 wherein said means for moving each said press brake die bottom engaging means above said surface of said press brake die receiving and holding means, also includes means for moving each said press brake die bottom engaging means below said surface of said press brake die receiving and holding means.

4. The mechanism as described in claim 3 wherein said press brake die bottom engaging means is a roller.

5. The mechanism as described in claim 4 wherein said means for moving each said press brake die bottom engaging means above said surface of said press brake die receiving and holding means includes a means for imparting motion, and a rotatable shaft having a first and a second end, said first end being movably linked to said motion imparting means and said second end having an eccentric which is connected to said roller.

6. A mechanism for disengaging and installing a press brake die on a press brake, the mechanism comprising:

a filler block mounted on the press brake, said filler block including press brake die receiving and holding means having a longitudinal surface, and a plurality of spaced apart cavities disposed along said longitudinal surface of said filler block;

a plurality of rollers, each said roller being disposed in one such cavity; and means for moving each said roller above said surface of said press brake die receiving and holding means to thereby engage the bottom of any press brake die which is held by said press brake die receiving and holding means, and move any such die away from and out of contact with said surface of said press brake die receiving and holding means.

7. The mechanism as described in claim 6 wherein said means for moving each said roller above said surface of said press brake die receiving and holding means includes a means for imparting motion, and wherein there are a plurality of crankshafts mounted in the filler block, each crankshaft having a first end and a second end, said first end of each said crankshaft being connected to one said roller, and said second end of each said crankshaft being disposed within said filler block and being movably linked to said motion imparting means.

8. The mechanism as described in claim 7 wherein there are means for linking said motion imparting means and said crankshaft, and wherein said motion imparting means is a cylinder and piston capable of motion in a first and in a second direction, said piston being connected to said linking means for pivoting said linkage in a first direction when said piston is moved in a first direction, whereby each said crankshaft is rotated in a manner which causes each said roller to move above said surface of said press brake die receiving and holding means to thereby engage the bottom of any press brake die which is held by said press brake die receiving and holding means to thereby move any such die away from and out of contact with said surface of said press brake die receiving and holding means, and whereby further, when said piston is moved in a second direction it causes movement of said linkage in a second direction, which is then causes each said crankshaft to be rotated in a manner which causes each said roller to move below said surface of said press brake die receiving and holding means to thereby allow any press brake die which is present to move into contact with said surface of said press brake die receiving and holding means.

9. The mechanism as described in claim 8 wherein each said crankshaft includes an eccentric portion at said first end of said crankshaft, said eccentric portion of said crankshaft being connected to the center of the associated roller, whereby, when said linkage is moved in a first direction when said piston is moved in a first direction, each said eccentric portion of each said crankshaft causes each said roller to be rotated eccentrically in a manner such that it moves above said surface of said press brake die receiving and holding means to thereby engage the bottom of any press brake die which is held by said press brake die receiving and holding means to thereby move any such die away from and out of contact with said surface of said press brake die receiving and holding means, and whereby further, when said piston is moved in a second direction movement of said linkage in a second direction causes each said eccentric portion of said crankshaft to be rotated in a manner which causes each said roller to be rotated eccentrically in a manner such that it moves below said surface of said press brake die receiving and holding means to thereby allow any press brake die which is present to move into contact with and roll along said surface of said press brake die receiving and holding means.

10. The mechanism as described in claim 9 wherein said rollers are connected to said eccentric portion of said crankshaft by bearings.

11. The mechanism as described in claim 7 wherein there are lever arms connected to said second end of said crankshaft, and wherein said linking means between said crankshaft and said piston is one or more connecting rod connected between each said lever arm and said piston.

12. The mechanism as described in claim 7 wherein said cylinder is a pneumatic cylinder.

13. The mechanism as described in claim 12 which further includes means for actuating said pneumatic cylinder and piston.

14. The mechanism as described in claim 7 further including a plurality of bushings disposed in said filler block for receiving said crankshafts therein.

15. The mechanism as described in claim 14 further including a plurality of thrust plates connected to said filler block, each said thrust plate engaging a portion of said second end of each said crankshaft to prevent axial movement of that crankshaft along the length of said bushing.

16. A mechanism for disengaging and installing a press brake die on a press brake, the mechanism comprising:

a filler block mounted on the press brake, said filler block including press brake die receiving and holding means having a longitudinal surface, and a plurality of spaced apart cavities disposed along said longitudinal surface of said filler block;

a plurality of rollers, each said roller being disposed in one such cavity for movement out of said cavity above said longitudinal surface of said filler block;

a plurality of bushings disposed in said filler block;

a plurality of crankshafts rotatably mounted within said bushings within said filler block, each said crankshaft having a first end and a second end, each said crankshaft including an eccentric portion at said first end of each said crankshaft, said eccentric portion of each said crankshaft being connected to the center of an associated roller;

a plurality of thrust plates connected to said filler block, each said thrust plate engaging a portion of said second end of each said crankshaft, whereby axial movement of that crankshaft on said filler block is prevented;

at least one piston and pneumatic cylinder combination for imparting motion to said piston in a first direction and in a second direction;

at least one lever arm connected to said second end of each said crankshaft;

linking means between each said lever arm and each said piston, said linking means including one or more connecting rod connected between each said lever arm and said piston, thereby effectively linking each said second end of each said crankshaft to each said piston, whereby, when said piston is moved in a first direction, each said crankshaft is rotated in a manner which causes each said eccentric portion of each said crankshaft to be rotated eccentrically to thereby move said connected roller above said surface of said press brake die receiving and holding means to thereby engage the bottom of any press brake die which is held by said press brake die receiving and holding means to thereby move any such die away from and out of contact with said surface of said press brake die receiving and holding means, and whereby further, when said piston is moved in a second direction movement of said linkage in a second direction causes each said eccentric portion of each said crankshaft to be rotated in a manner which causes each said roller to be rotated eccentrically to thereby move below said surface of said press brake die receiving and holding means to thereby allow any press brake die which is present to move into contact with and roll along said surface of said press brake die receiving and holding means.

17. The mechanism as described in claim 16 wherein said linking means includes two or more rods connected in series with one another, with one end of said series of rods connected to said piston, and with one end of said series of rods connected to a said lever arm.

18. The mechanism as described in claim 16 further including a control panel mounted on a hinged bracket attached to the press brake, a switch mounted on said control panel, said switch operatively connected to said pneumatic cylinder for actuating said piston in a first direction and also for actuating said piston in a second direction.

19. The mechanism as described in claim 16 wherein, when the press brake is intended for use with a press brake die having a die tang on its bottom along the length thereof, said press brake die receiving and holding means carries a filler block groove along the longitudinal surface thereof for receiving such a die tang, and said cavities are disposed along the surface of said filler block groove.

20. The mechanism as described in claim 16 wherein, the mechanism is in the lower half of the press brake and is used to move and disengage a female press brake die from the press brake die receiving and holding device.

21. A mechanism for disengaging and installing a press brake die on a press brake, the mechanism comprising:

press brake die receiving and holding means having a longitudinal surface;

a plurality of spaced apart openings defined along the length of said longitudinal surface of said press brake die receiving and holding means, each said opening terminating at said surface of said press brake die receiving and holding means, said termination of each said opening being substantially adjacent to any press brake die which may be received and held by said press brake die receiving and holding means;

a plurality of roller means for engaging the bottom of a press brake die, each said press brake die bottom engaging roller means being located within one said opening, each said press brake die bottom engaging roller means normally being within its said opening below said surface of said press brake die receiving and holding means, but capable of movement out of its opening and above said surface of said press brake die receiving and holding means to thereby engage the bottom of any press brake die which is received and held by said press brake die receiving and holding means, whereby any such die will be moved away from and out of contact with said press brake die receiving and holding means; and means for moving said plurality of press brake die bottom engaging roller means above said surface of said press brake die receiving and holding means to thereby engage the bottom of any press brake die which is held by said press brake die receiving and holding means, and move any such die away from and out of contact with said surface of said press brake die receiving and holding means, wherein said means for moving each said press brake die bottom engaging roller means above said surface of said press brake die receiving and holding means, also includes means for moving each said press brake die bottom engaging means below said surface of said press brake die receiving and holding means, and wherein said means for moving each said press brake die bottom engaging means above said surface of said press brake die receiving and holding means includes a means for imparting motion, and a rotatable shaft having a first and a second end, said first end being movably linked to said motion imparting means and said second end having an eccentric which is connected to said roller.

22. A mechanism for disengaging and installing a press brake die on a press brake, the mechanism comprising:

a filler block mounted on the press brake, said filler block including press brake die receiving and holding means having a longitudinal surface, and a plurality of spaced apart cavities disposed along said longitudinal surface of said filler block;

a plurality of rollers, each said roller being disposed in one such cavity; and means for moving each said roller above said surface of said press brake die receiving and holding means to thereby engage the bottom of any press brake die which is held by said press brake die receiving and holding means, and move any such die away from and out of contact with said surface of said press brake die receiving and holding means, wherein said means for moving each said roller above said surface of said press brake die receiving and holding means includes a means for imparting motion, and wherein there are a plurality of crankshafts mounted in the filler block, each crankshaft having a first end and a second end, said first end of each said crankshaft being connected to one said roller, and said second end of each said crankshaft being disposed within said filler block and being movably linked to said motion imparting means.

* * * * *